US007007991B1

(12) United States Patent
Sapp

(10) Patent No.: US 7,007,991 B1
(45) Date of Patent: Mar. 7, 2006

(54) REFUSE CONTAINER WITH REPLACEABLE BAG

(76) Inventor: James R. Sapp, 7 Ivy Trail, Greenville, SC (US) 29615

( * ) Notice: Subject to any disclaimer, the term of this patent is extended or adjusted under 35 U.S.C. 154(b) by 0 days.

(21) Appl. No.: 10/919,950

(22) Filed: Aug. 17, 2004

(51) Int. Cl.
*B65B 67/12* (2006.01)
*B65F 1/06* (2006.01)

(52) U.S. Cl. ..... 294/1.1; 248/99

(58) Field of Classification Search ..... 294/1.1, 294/1.3, 1.4, 1.5, 55; 248/99–101; 15/257.1; 24/300, 301
See application file for complete search history.

(56) References Cited

U.S. PATENT DOCUMENTS 792,677 A * 6/1905 Stowell ..... 59/79.1
1,153,334 A * 9/1915 Oswald ..... 24/498
3,688,483 A 9/1972 Hamilton ..... 56/400.11
3,942,832 A 3/1976 Haas, Jr. ..... 294/55
4,660,240 A * 4/1987 Hutton et al. ..... 5/669
4,723,803 A 2/1988 Sapp ..... 294/55
4,775,123 A 10/1988 Borland et al. ..... 248/99
5,039,149 A * 8/1991 Gish ..... 294/1.4
5,168,605 A * 12/1992 Bartlett ..... 24/519
5,711,563 A 1/1998 Sapp ..... 294/1.1

* cited by examiner

*Primary Examiner*—Dean J. Kramer
(74) *Attorney, Agent, or Firm*—Charles L. Schwab; Nexsen Pruet, LLC

(57) ABSTRACT

A hand held frame for holding a plastic bag open for reception of leaves including a U shaped frame over the open end of the bag is draped and elastic cords for holding the bag in place on the frame with a plate fastened to the end of each of the cords, the plate having an opening for hooking on a button on the frame.

3 Claims, 3 Drawing Sheets

REFUSE CONTAINER WITH REPLACEABLE BAG

BACKGROUND OF THE INVENTION

This invention relates to an improvement in apparatus for collecting leaves, trash and other debris which includes a U shaped frame with a handle and to which the open end of a flexible bag is releasably attached and held open. My previously designed devices used a pair elastic cords extending from the ends of a pair of arms to releasable connections on a shoulder area of the U shaped frame to maintain the bag in an open, debris receiving position. Releasable connections previously used include a button with a slot for wedging an end portion of the elastic cord that has been wrapped around the button, a button and a slot in the shoulder of the frame for wedgingly receiving an elastic cord which has been wrapped around the button and buttons on the shoulders and Velcro portions on the handle with non-elastic cords having Velcro patches on their ends for attachment to the Velcro portions on the handle after the cords are passed around their associated buttons.

Although the beforementioned bag holders successfully hold the bag open for collection for refuse they have not been entirely satisfactory from the standpoint of ease of use and positive attachment of the ends of the cords holding the open end of the bag in place. The Velcro components may become clogged with thrash particles and the ends of the cords may release from the slots in which they were wedged by the knotted ends being engaged by trash being bagged.

BRIEF DESCRIPTION OF THE INVENTION

A pair of elastic cords having first corresponding ends attached to the end of a pair of arms of a U shaped plastic hand carried device for maintaining a plastic bag in an open position to receive leaves, refuse and the like. The arms and shoulders of the U shaped apparatus have protrusions over which a cuff or hem of an open end of the plastic bag extends. An open end of a plastic bag is folded over the arms and shoulders of the U shaped apparatus. The cords, which have a first corresponding ends connected to the ends of the arms, are passed over or under the projections on the arms and second corresponding ends of the cords are releasably secured respectively to buttons on the shoulders by a thin flat stiff plate attached to each of the second ends of the cords. The plates each have an opening larger than the buttons on the shoulders by which the plates hook on the buttons.

BRIEF DESCRIPTION OF THE DRAWINGS

One embodiment of the invention is illustrated in the drawings in which.

DETAILED DESCRIPTION OF THE INVENTION

Figure 1:
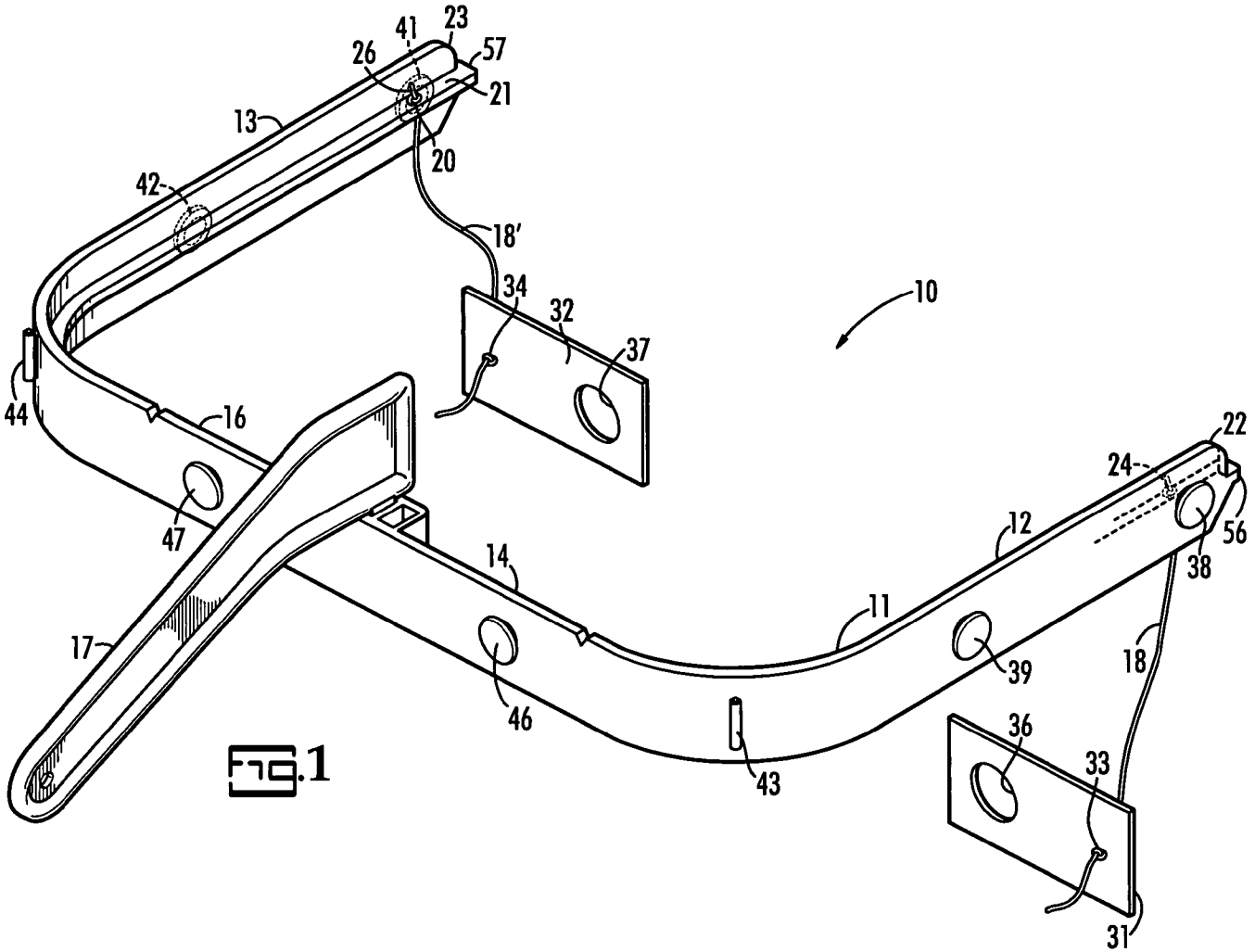
FIG. 1 is a perspective view of the hand held apparatus for holding a plastic trash bag in open position.

FIG. 1 shows a hand held apparatus 10 which includes a rigid plastic U shaped frame 11 having a pair of arms 12, 13, a pair of shoulders 14, 16 and a rigid plastic handle 17 securely attached to the shoulders 14, 16 at their juncture.

Figure 3:
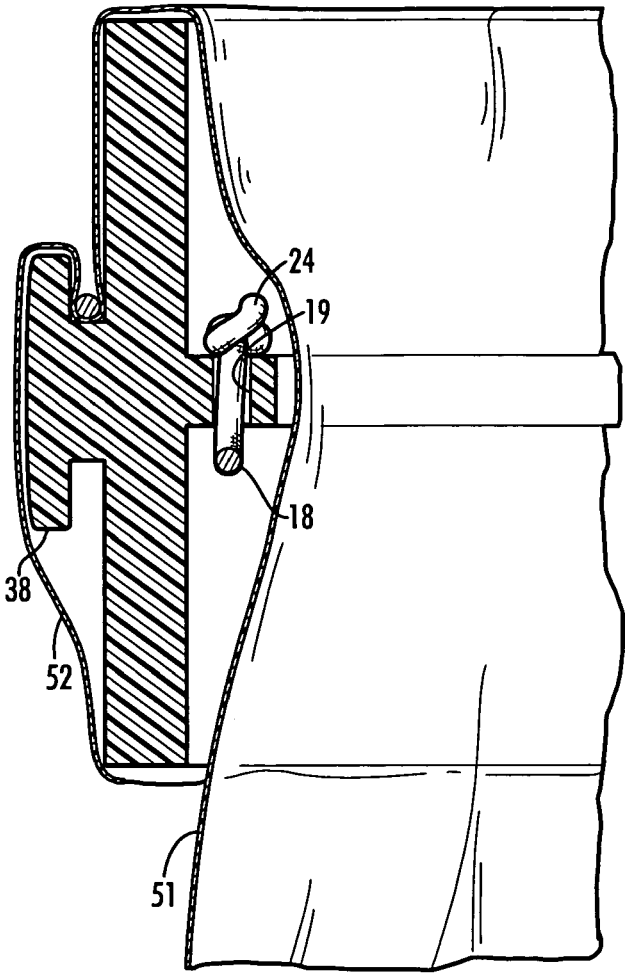
FIG. 3 is a section taken on the line 3—3 in FIG. 2.
Figure 4:
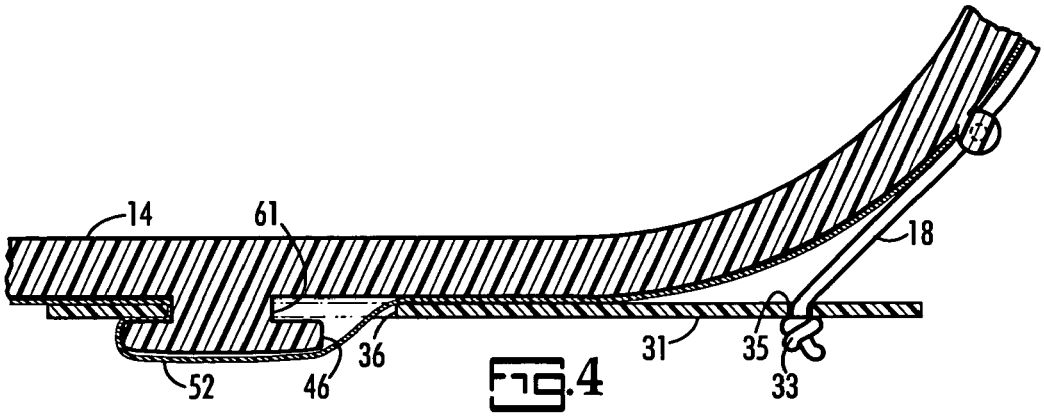
FIG. 4 is a section taken on the line 4—4 in FIG. 2.

The arms 12, 13 and shoulders 14, 16 present flat surfaces forming a skirt about which the open end of a leaf bag 51 may be folded to form a cuff or hem portion 52. A flange 21 is formed on the inside of the arms 12, 13 and shoulders 14, 16 and a pair of elastic cords 18, 18' have first corresponding ends which pass through openings 19, 20 in the flange 21 near the free ends 22, 23 of the arms 12, 13 and the ends are knotted forming knots 24, 26. The opening 19 is clearly shown in FIG. 3. A pair of identical thin flat stiff rectangular plates 31, 32 are attached to second corresponding ends of the elastic cords 18, 18' by passing those ends through small openings near one end of the rectangular shaped plates 31, 32 and then the ends are knotted forming knots 33, 34 to prevent removal of the plates 31, 32 from the cords 18, 18'. FIG. 4 shows the cord 18 passing through a small hole or opening 35 in the plate 31. The plates 31, 32 have relatively large annular holes 36, 37 near their other ends.

Projections in the form of buttons 38, 39 are formed on the outer side of the arm 12 and similar or identical annular buttons 41, 42 are formed on the outer side of the arm 13. Guideposts 43, 44 are formed on the outer side of the curved connections between the arms 12, 13 and the shoulders 14, 16, respectively, and annular buttons 46, 47 are formed on the shoulders for receiving the plates 31, 32. The annular buttons 46, 47 have reduced diameter stems. The reduced diameter stem 61 of the button 46 is shown in FIG. 4.

Figure 2:
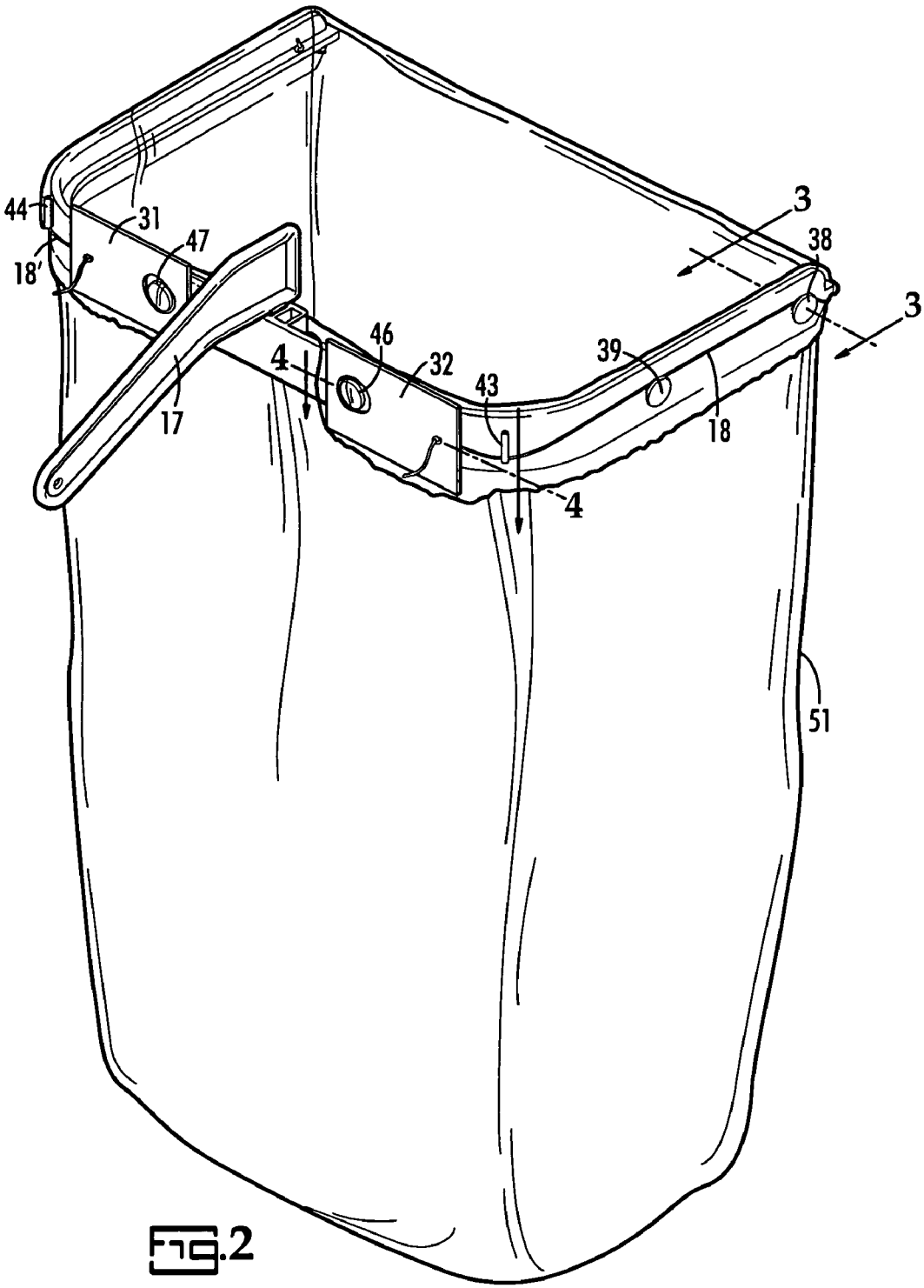
FIG. 2, is a perspective view showing a plastic trash bag installed on the hand held apparatus.

In preparing to use the bagging apparatus 10, the open end of a plastic bag 51 is draped over the U shaped frame 11 forming a cuff or hem portion 52 covering the outward facing sides of the arms 12, 13 and shoulders 14, 16 of the U shaped frame 11. The elastic cord 18 holds the hem portion or cuff 52 of the bag 51 in place by its being wrapped around a projection 56 on the end of the arm 12, over the projections 38, 39 and under projection 43. Then the plate 31 is releasably fastened to the button 46, as shown in FIGS. 2 and 4, by passing the slightly larger diameter annular opening 36 over the button 46 and hooking the plate 31 on the reduced diameter portion or stem 61 of the button 46. In a like manner the cord 18' is wrapped around a projection 57 on the end of the arm 13 and then over the projections 41, 42 on the arm 13, then under the post 44 and then the plate 32 is hooked on the reduced diameter portion or stem of the button 47. The plastic bag 51 has now been attached to the hand held bag holding apparatus 10, as illustrated in FIG. 2. The bag 51 is released from the hand held apparatus by unhooking the plates 31, 32 from the buttons 46, 47. The herein described plastic bag holder 10 not only effectively holds the bag 51 in an open position but also permits quick attachment and removal of the bag and provides long trouble free service.

As shown in FIG. 4, the elastic cord 18 not only maintains the elongated plate 31 in a hooked connection with the button 46 but also biases the plate 31 toward the plastic bag cuff 52 and the shoulder 14, thereby helping to retain the bag on the U-shaped frame 11. The longitudinal end portion of the plate 31, to which the elastic card 18 is connected, is spaced from the frame at the curved connection of the frame 11 between the arm 12 and the shoulder 14, which results in the cord 18 biasing a flat side of the plate 31 against the bag cuff 52 thereby holding the bag cuff 52 against the shoulder 14. Also the spacing of longitudinal end of the flat plate 31, to which the elastic cord 18 is attached, from the curved corner of the U-shaped frame 11 makes it easier to grip the plate 31 when it is being disconnected from the button 46, than if the entire plate 31 engaged the bag cuff 52 covering the rear flat surface of the shoulder 14. In a like manner, the longitudinally opposite ends of the elongated plate 32 are connected to the button 47 and the elastic cord 18'.

What is claimed is:

1. A molded plastic hand carried leaf bagging device for positioning a leaf bag in an open position to receive leaves and the like, comprising:

a U shaped frame having a pair of arms projecting forwardly from a pair of shoulders to spaced apart ends and a handle extending rearwardly from the juncture of said shoulders, said arms and shoulders presenting a substantially flat surface affording a skirt about which an open edge of a leaf bag may be folded to place a hem portion folded in confronting relation to the outward facing sides of said arms and shoulders and with said leaf bag disposed in open configuration to receive leaves;

a pair of elastic cords having first and second corresponding ends, said first corresponding ends being connected, respectively, to said spaced apart ends of said arms, projections on said outward facing sides of said arms and shoulders positioning said cords about said arms and shoulders thereby releasably holding said open edge of said leaf bag on said leaf bagging device, a projection formed on the outward facing side of each of said shoulders, being in the form of a an annular button with a reduced diameter stem, and a pair of elongated thin stiff flat plates having first and second longitudinally opposite ends, said first corresponding ends of said plates being connected to said second corresponding ends of said elastic cords and said second corresponding ends of said plates having an annular opening slightly larger than said button, said plates being releasably engaged with said buttons by placing said openings in engagement with said reduced diameter stem of said buttons, respectively, said elastic cords holding the associated flat plates against said hem portion of said bag toward said flat surfaces of said shoulders, respectively.

2. The leaf bagging device of claim 1 wherein said plate has a rectangular shape.

3. The leaf bagging device of claim 1 wherein a central part of each of said plates is held in flat thrust transmitting engagement with said hem portion of said bag and wherein said first ends of said plates are spaced from said frame.

* * * * *